United States Patent [19]

Clay

[11] 4,010,765

[45] Mar. 8, 1977

[54] COIN CHANGER WITH SPRING-BIASED SLIDES

[75] Inventor: Howard W. Clay, Rockford, Ill.

[73] Assignee: Reed Industries, Inc., Rockford, Ill.

[22] Filed: Mar. 1, 1976

[21] Appl. No.: 662,322

[52] U.S. Cl. ..... 133/4 A

[51] Int. Cl.² ..... G07D 1/02

[58] Field of Search ..... 194/10, 2; 133/4 A, 133/4 R; 221/271

[56] References Cited

UNITED STATES PATENTS

| | | | |
|---|---|---|---|
| 2,125,058 | 7/1938 | Bachardy | 133/4 R |
| 2,600,961 | 6/1952 | Biehl | 221/271 X |
| 2,605,774 | 8/1952 | Damon et al. | 133/4 R |
| 3,215,151 | 11/1965 | Heim et al. | 133/4 R X |

*Primary Examiner*—Stanley H. Tollberg
*Attorney, Agent, or Firm*—Leydig, Voit, Osann, Mayer and Holt, Ltd.

[57] ABSTRACT

Two reciprocating slides are biased toward payout positions by coiled compression springs which are located so as to reduce cocking and skewing of the slides as the slides move to and from their payout positions. Each spring is compactly located in an opening in its slide and is sandwiched between stationary plates disposed above and below the slide.

8 Claims, 5 Drawing Figures

COIN CHANGER WITH SPRING-BIASED SLIDES

BACKGROUND OF THE INVENTION

This invention relates to a coin changer having a payout mechanism with at least one slide which is capable of moving horizontally past a coin storage tube so as to pay out a coin from the tube. The payout mechanism is of the same general type as disclosed in Schmitt U.S. application Ser. No. 531,657, filed Dec. 11, 1974 now U.S. Pat. No. 3,972,338 and assigned to the assignee of the present invention. In such a payout mechanism, the slide is sandwiched between an upper base plate and a lower stationary plate and normally is disposed in a home position. A power-operated cam is supported on the base to rotate about a vertical axis and, upon being actuated through a payout cycle, first releases the slide to move to a payout position and discharge a coin from the storage tube.

Movement of the slide to its payout position is effected by a spring which acts on the slide to shift the latter. After the slide has been moved to its payout position by the spring, the cam engages the slide to return the slide to its home position. A second slide may be sandwiched between the stationary plate and a bottom plate and may be actuated to pay out a coin from a second storage tube on the base. A second spring acts on the second slide to move the latter to its payout position.

SUMMARY OF THE INVENTION

The general aim of the present invention is to provide new and improved coin changer payout mechanisms having slide-actuating springs which are uniquely located to reduce the tendency of the slides to cock or skew horizontally as the slides are moved between their positions.

A more detailed object is to achieve the foregoing by locating each spring substantially along the line where force is exerted on the slide by the cam so as to reduce the turning moment applied to the slide by the spring and the cam.

Still another object is to compactly nest each spring within its slide and between the plates disposed above and below the slide.

These and other objects and advantages of the invention will become more apparent from the following detailed description when taken in conjunction with the accompanying drawings.

DETAILED DESCRIPTION OF THE PREFERRED EMBODIMENT

Figure 1:
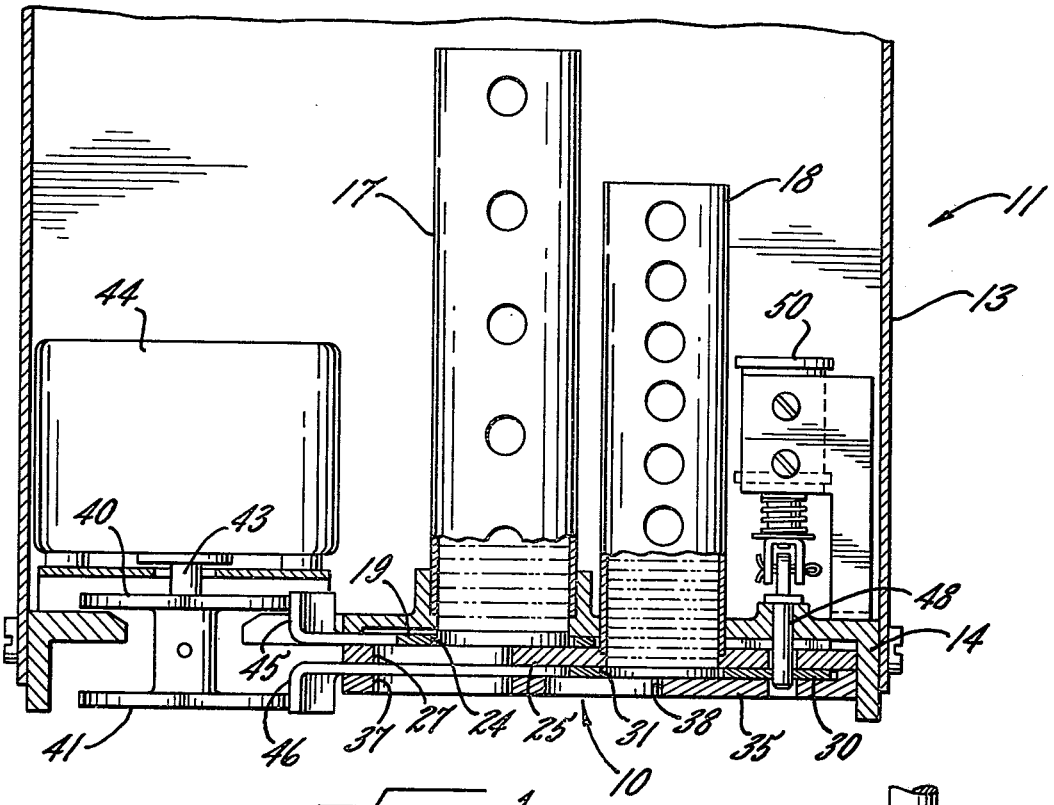
FIG. 1 is a fragmentary cross-section of a new and improved coin changer incorporating the unique features of the present invention, the section being taken substantially along the line 1—1 of FIG. 2.

As shown in the drawings for purposes of illustration, the invention is embodied in a payout mechanism 10 for a coin changer 11 which preferably but not necessarily is of the type that is capable of paying out change in coins of two different denominations when the sum deposited in the changer exceeds the vend price. The present changer accepts nickels, dimes and quarters and pays out change in the form of nickels and dimes. For example, when a quarter is deposited, the changer will pay out a nickel if the vend price is twenty cents, will pay out a dime if the vend price is fifteen cents and will pay out a nickel and a dime if the vend price is ten cents.

More specifically, the changer 11 includes a channel-shaped housing 13 within which the payout mechanism 10 is mounted. The payout mechanism comprises a main horizontal supporting plate or base 14 formed with holes 15 and 16 (FIG. 2) which receive nickel and dime storage tubes 17 and 18, respectively. Immediately underlying the base is a nickel payout slide 19 which is supported to move horizontally back and forth in a linear path from a home position to a payout position, the slide being biased toward the payout position by a spring 20. The nickel slide is formed with a hole 24 which registers with the nickel hole 15 in the base 14 and receives the lowermost nickel in the tube 17 when the slide is in its home position shown in FIG. 1. As the slide moves to its payout position (i.e., to the left in FIGS. 1 and 2), the lowermost nickel is moved along with the slide and falls downwardly from the hole 24 when the slide reaches its payout position. The slide then is returned reversely to its home position.

Located beneath the nickel slide 19 and fixed rigidly to the base 14 is a divider plate 25. The latter is formed with one hole 26 (FIG. 2) which is alined with the dime hole 16 in the base 14 and also is formed with another hole 27 which registers with the hole 24 in the nickel slide 19 when the nickel slide is in its payout position. The nickel slide 19 is formed with an elongated slot 29 which enables the dime tube 18 to extend downwardly into the hole 26 in the divider plate 25.

Figure 2:
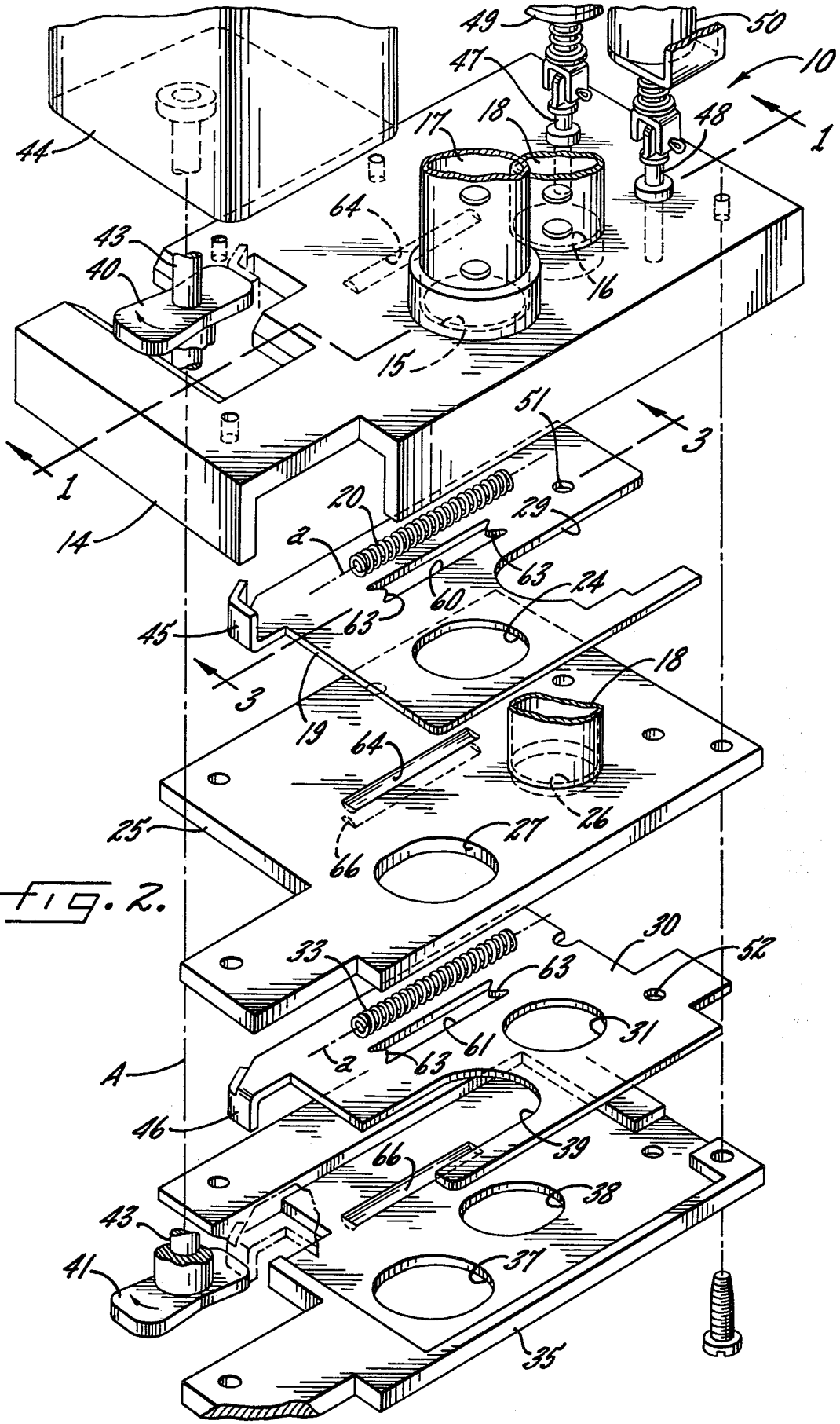
FIG. 2 is an exploded perspective view of parts of the coin changer.

As shown in FIG. 2, a dime slide 30 underlies the divider plate 25 and, like the nickel slide 19, is mounted to move horizontally from right to left in a linear path from a home position to a payout position. When the dime slide 30 is in its home position, a hole 31 formed through the slide is alined with the dime tube 18 and receives the lowermost dime of the stack captivated by the tube. When the dime slide 30 is moved to its payout position, the dime drops out of the hole 31. Movement of the dime slide to its payout position is effected by a spring 33.

A bottom 35 is fixed rigidly to the base 14 and is formed with a nickel hole 37 (FIG. 2) and a dime hole 38 which register with holes 24 and 31 in the slides 19 and 30, respectively, when the latter are in their payout positions. When the nickel slide 19 is in its payout position, an elongated slot 39 formed in the dime slide 30 enables the hole 37 in the bottom plate 35 to communicate with the hole 24 in the nickel slide regardless of the position of the dime slide.

To control movement of the slides 19 and 30, two generally elliptical and angularly alined cams 40 and 41 (FIG. 2) are fixed to and spaced axially along the vertically depending drive shaft 43 of a power actuated operator in the form of a small electric motor 44 which is supported on the upper side of the base 14. The cam 40 is directly engageable with an upstanding lug 45 on the nickel slide 19 while the cam 41 is directly engageable with a depending lug 46 on the dime slide 30. Prior to the beginning of each payout cycle, the cams are positioned with their long sides in engagement with the lugs. As the cams are initially rotated, the long sides of the cams move away from the lugs and release the slides 19 and 30 to the action of the springs 20 and 33. As the cams approach 180 degrees rotation to end the payout cycle, the opposite long sides of the cams bear against the lugs and return to the home position any slide which has been moved to its payout position by its respective spring. During the next payout cycle, the cams rotate through another one-half revolution to again release the slides to the action of the springs and then return any slide which has been moved to its payout position. As each slide moves to its payout position, it carries its coin to a location where the coin may drop through the hole 37, 38 in the bottom plate 35 for return to the purchaser.

Movement of the slides 19 and 30 preferably is controlled in a manner which enables either or both of the slides to move to the payout position during a single payout cycle. In this way, the changer can be made to pay out either a single nickel or a single dime or the combination of both a nickel and a dime during any given payout cycle.

To achieve the foregoing, independently operable latches 47 and 48 (FIG. 2) are associated with the nickel and dime slides 19 and 30, respectively. Herein, the latches are in the form of plungers which are adapted to be reciprocated vertically between released and latched positions in response to the energization and de-energization of solenoids 49 and 50 mounted on the upper side of the base 14. When the slides are in their home positions and the solenoids are de-energized, the plunger 47 is urged downwardly into a hole 51 in the nickel slide 19 while the plunger 48 is urged downwardly into a hole 52 in the dime slide 30. Under these conditions, each slide is positively latched in its home position and neither can be moved to its payout position by its spring 20, 33 even though the cams 40, 41 are positioned to permit such movement.

When a change making cycle is to be initiated, logic circuitry (not shown) associated with the changer 11 causes energization of the payout motor 44 to effect turning of the cams 40 and 41. Just prior to energizing the motor, the logic circuitry causes energization of either or both of the solenoids 49 and 50, the solenoid which is energized being dependent upon the amount of change to be returned as determined by the logic circuitry. If only the solenoid 49 is energized, the plunger 47 is retracted from the hole 51 in the nickel slide 19 to permit movement of that slide to its payout position by the action of the spring 20. The solenoid 50 remains de-energized to hold the dime slide 30 in its home position and thus only a nickel is paid out during rotation of the cams 40 and 41 through their cycle of one-half revolution.

By the same token, energization only of the solenoid 50 results in retraction of the plunger 48 from the hole 52 in the dime slide 30 so as to enable the spring 33 to move the dime slide to its payout position. Since the solenoid 49 remains de-energized, the nickel slide 19 remains latched in its home position by the plunger 47 and thus only a dime is paid out during rotation of the cams through one-half revolution.

When the solenoids 49 and 50 are energized simultaneously, both slides 19 and 30 are released and both move to their payout positions at the same time so that both a nickel and a dime are paid out during one-half revolution of the cams 40 and 41.

As described thus far, the payout mechanism 10 is virtually identical to the payout mechanism described in the aforementioned Schmitt application. In that payout mechanism, however, difficulty has been encountered as a result of the slides cocking or skewing horizontally as the slides move between their positions. In accordance with the present invention, the tendency of the slides 19 and 30 to cock or skew is reduced by locating the springs 20 and 33 substantially in line with the points at which the cams 40 and 41 apply force to the slides. As a result, the forces acting in opposite directions on each slide are substantially alined so as to reduce the turning moment applied to the slide and thus reduce the tendency of the slide to cock.

More specifically, each of the springs 20, 33 is a coiled compression spring and each is located with its axis *a* (FIG. 2) paralleling the path of movement of the slide 19, 30 and lying along a line which intersects or nearly intersects the rotational axis A of the cams 40 and 41. In keeping with the invention, each spring is compactly nested within its slide and is sandwiched between the plates 14 and 25 or 25 and 35 disposed above and below the slide. Thus, the springs 20 and 33 are disposed in elongated openings 60 and 61 formed through the slides 19 and 30, respectively, there being tabs 63 projecting from opposite end portions of each opening and projecting into the end portions of the associated spring to help retain the spring in the opening. With the springs being located in the openings, the axis of each spring is located in the plane of the associated slide.

To accommodate the spring 20, grooves 64 (FIGS. 2 and 3) are formed in the lower side of the base 14 and the upper side of the divider plate 25, these grooves receiving the upper and lower sides of the spring. Similarly, grooves 66 (FIGS. 2 and 4) are formed in the lower side of the divider plate 25 and the upper side of the bottom plate 35 to receive the upper and lower sides of the spring 33. Thus, the springs are located compactly between the various plates and slides and, being so located, can be positioned so that their axes *a* substantially intersect the axis A and yet the springs are not obstructed by and do not interfere with elements located above the base 14 or below the bottom plate 35.

Figure 3:
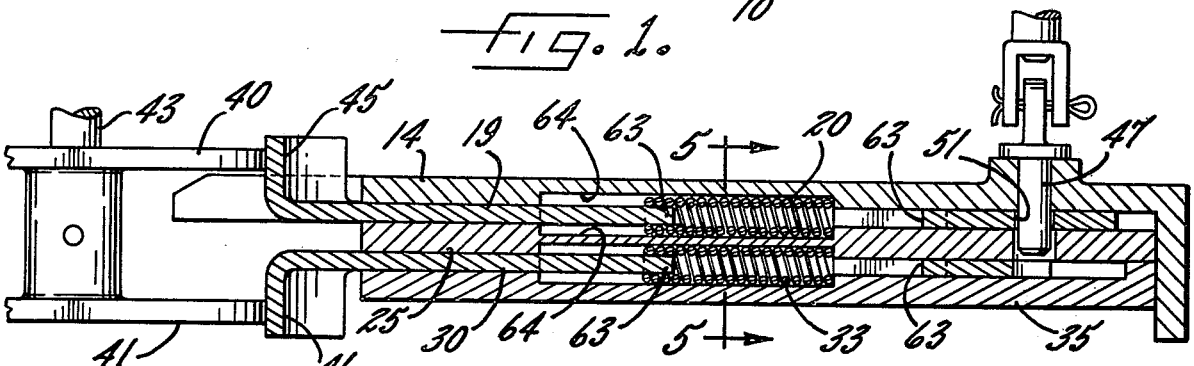
FIG. 3 is an enlarged fragmentary cross-section taken substantially along the line 3—3 of FIG. 2.
Figure 4:
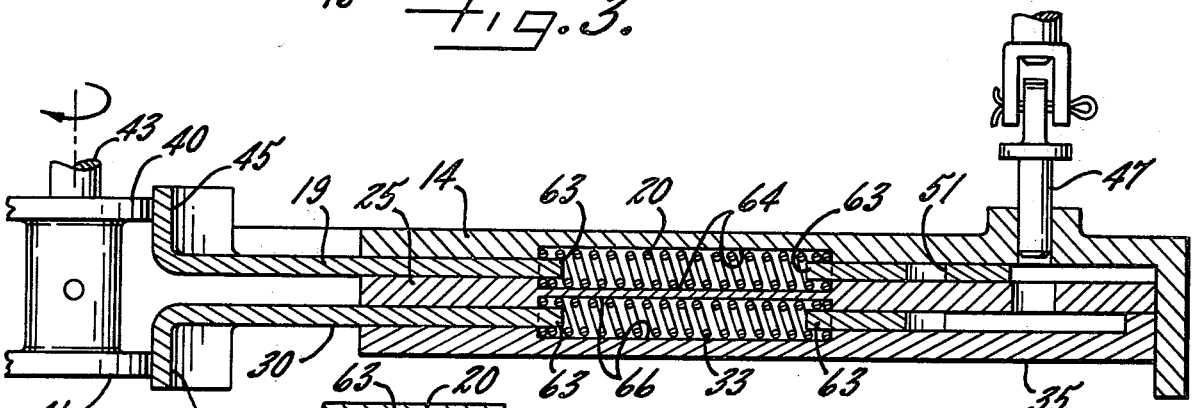
FIG. 4 is a view similar to FIG. 3 but shows parts in moved positions.
Figure 5:
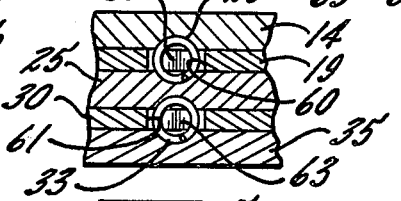
FIG. 5 is a fragmentary cross-section taken substantially along the line 5—5 of FIG. 3.

When the slides 19 and 30 are in their home positions as shown in FIG. 3, the spring 20 is compressed between the left end of the opening 60 and the right end walls of the grooves 64 while the spring 33 is compressed between the left end of the opening 61 and the right end walls of the grooves 66. Then, when the cams 40 and 41 release the slides, the springs expand and shift the slides to their payout positions as shown in FIG. 4. By virtue of the location of the springs relative to the location of the cams, the slides are caused to move in a substantially straight line since the turning moment exerted on the slides by the cams is substantially balanced by that exerted by the springs. Accordingly, cocking of the slides is reduced so as to enable the payout mechanism 10 to operate in a more trouble-free manner and to increase the service life of the mechanism.

I claim:

1. A coin changer having a coin payout mechanism, said mechanism comprising a base, first and second coin storage tubes supported on said base, a first slide underlying said base and reciprocable horizontally back and forth in a linear path beneath said base from a home position to a payout position, a stationary divider plate underlying said first slide, a second slide underlying said divider plate and reciprocable horizontally back and forth in a linear path beneath said divider plate from a home position to a payout position, a stationary bottom plate underlying said second slide, each of said slides being operable when moved from its home position to its payout position to discharge a coin from its respective coin tube and through said bottom plate, a power operated cam means rotatable about a vertical axis and operable when actuated through one payout cycle to release said slides for movement to said payout positions and then to return to said home position any slide which has been moved to said payout position, the improvement in said coin changer comprising, first and second coiled compression springs for moving said first and second slides, respectively, to said payout positions, each of said springs having an axis substantially intersecting the rotational axis of said cam means and extending parallel to the linear path followed by the respective slide, said first spring being disposed within an opening in said first slide and having one end engageable with said first slide and an opposite end engageable with said base and said divider plate, and said second spring being disposed in an opening in said second slide and having one end engageable with said second slide and an opposite end engageable with said divider plate and said bottom plate.

2. A coin changer as defined in claim 1 in which grooves are formed in the lower side of said base and the upper side of said divider plate and receive said first spring, there being additional grooves formed in the lower side of said divider plate and the upper side of said bottom plate to receive said second spring.

3. A coin changer as defined in claim 2 further including tabs formed at opposite ends of each of said openings and projecting into the end portions of the spring disposed in such opening.

4. A coin changer having a coin payout mechanism, said mechanism comprising a base, a coin storage tube supported on said base, a slide underlying said base and reciprocable horizontally back and forth in a linear path beneath said base from a home position to a payout position, a stationary plate underlying said slide, said slide being operable when moved from said home position to said payout position to discharge a coin from said coin tube and through said plate, a power operated cam on said base and rotatable about a vertical axis, said cam being operable when rotated through one payout cycle to release said slide for movement to said payout position and then to return said slide to said home position if said slide moved to said payout position when released, the improvement in said coin changer comprising, a coiled compression spring for moving said slide to said payout position, said spring being disposed within an opening formed in said slide and having one end engageable with said slide and an opposite end engageable with at least one of said base and said plate, and said spring having an axis substantially intersecting the rotational axis of said cam and extending parallel to and in the plane of the linear path followed by said slide.

5. A coin changer as defined in claim 4 in which said opening extends through said slide and in which said opposite end of said spring engages both said base and said plate, and grooves formed in the lower side of said base and the upper side of said plate to receive said spring.

6. A coin changer having a coin payout mechanism, said mechanism comprising a base, a coin storage tube supported on said base, a slide underlying said base and reciprocable horizontally back and forth in a linear path beneath said base from a home position to a payout position, a stationary plate underlying said slide, said slide being operable when moved from said home position to said payout position to discharge a coin from said coin tube and through said plate, power operated cam means rotatable about a vertical axis and operable when actuated through one payout cycle to release said slide for movement to said payout position and then to return said slide to said home position if said slide moved to said payout position when released, the improvement in said coin changer comprising, a coil spring for moving said slide to said payout position, said spring being a compression spring and being disposed in an opening in said slide, said spring having one end located to bear against one end of said opening and having an opposite end adapted to bear against said base and said plate, and said spring having an axis substantially intersecting the rotational axis of said cam means and extending parallel to the linear path followed by said slide.

7. A coin changer as defined in claim 6 in which the axis of said spring is disposed in the plane of said slide.

8. A coin changer as defined in claim 6 in which grooves are formed in the lower side of said base and the upper side of said plate and receive said spring, said opposite end of said spring bearing against one end of each of said grooves.

* * * * *